US005675869A

United States Patent [19]

Lotz

[11] Patent Number: 5,675,869

[45] Date of Patent: Oct. 14, 1997

[54] DOOR LOCK AND AN INTEGRAL DOOR HINGE ASSEMBLY

[75] Inventor: Norbert Lotz, Leichlingen, Germany

[73] Assignee: Ed. Scharwachter GmbH & Co. KG., Remscheid, Germany

[21] Appl. No.: 734,371

[22] Filed: Oct. 17, 1996

[30] Foreign Application Priority Data

Oct. 17, 1995 [DE] Germany ..... 195 38 561.6

[51] Int. Cl.[6] ..... E05D 11/10

[52] U.S. Cl. ..... 16/334; 16/308; 16/297; 16/332

[58] Field of Search ..... 16/334, 333, 343, 16/344, 308, 273, 275, 276, 296, 297, 332

[56] References Cited

U.S. PATENT DOCUMENTS 4,285,098 8/1981 Hicks et al. ..... 16/308

4,536,918 8/1985 Brockhaus ..... 16/308

*Primary Examiner*—Chuck Y. Mah

*Attorney, Agent, or Firm*—Anderson Kill & Olick, P.C.

[57] ABSTRACT

A door lock for a motor vehicle door, and which is to be formed integrally with a motor vehicle door hinge, including a torsional spring supportable on one hinge half and having a weighting arm which extends parallel to a door hinge axis and projects beyond a door hinge height, at least three, substantially identical abutment rollers having a substantially heart-shaped cardioid cross-section at least along a portion of their height, pivotally supportable next to each other and in a spaced relationship relative to the door hinge axis on the abutment support, and cooperating with the weighting arm of the torsional spring for defining indexing positions in which the door can be retained during its opening movement, and three bearing axles for supporting the abutment rollers on the abutment support and arranged on the abutment support of a distance from each other, which is less than the largest diameter of the cross-section of the abutment rollers.

13 Claims, 4 Drawing Sheets

DOOR LOCK AND AN INTEGRAL DOOR HINGE ASSEMBLY

BACKGROUND OF THE INVENTION

1. Field of the Invention

The present invention relates to a door lock for a motor vehicle door and to an integral door hinge assembly including the door lock, with the door lock having a torsional spring which is supportable on one of the door hinge halves and has a weighting arm extending parallel to the hinge axis and projecting beyond the hinge height, and which further has a plurality of abutment rollers supported on the other of the door hinge halves and cooperating with the weighting arm for locking the door at least in one of the door opening positions.

2. Description of the Prior Art

Italian Patent No. 728,110 discloses an integral door hinge assembly of the above discussed type in which two abutment rollers are provided with a peripheral toothing and are arranged on the corresponding hinge half at a substantial distance from each other, which at least exceeds their diameter. Upon the door being opened, the weighting arm of the torsional spring engages the first of the two abutment rollers in the vicinity of the first indexing or locking position of the door.

The first abutment roller deflects the weighting arm a certain amount which leads to braking of the opening movement of the door until the weighting arm, during further opening of the door and after a partial rotation of the first abutment roller, engages the second roller and becomes locked between the two rollers. Because the abutment rollers are spaced from each other at a relatively substantial distance, an increased play takes place between the weighting arm, which initially engages only one of the abutment rollers, and the other abutment roller. As a result of this, a noticeable freedom of motion of the vehicle door exists in the vicinity of the selected indexing or locking position of the door during its opening. In addition, in the door hinge assembly of the Italian patent in which the toothed abutment rollers are used, there exists a possibility that the weighting arm of the torsional spring, upon contact with the second roller, would engage a tooth of the second roller and would not be reliably locked. This would result in that the door would move out of the pre-determined locking position a certain amount in one of the opening and closing movement directions of the door.

The possibility that the weighting arm of the torsional spring during a contact with the second roller can engage a tooth also follows from the structure of the door hinge assembly shown in FIG. 5 of the above-mentioned Italian patent, in which the abutment rollers are spaced by a relatively short distance from each other. Thus, in the assembly of the type disclosed in the Italian patent, an undesirable oscillating movement of the door in the region of the indexing opening position of the door cannot be reliably avoided. This oscillating movement of the door is very undesirable, as it can result in damage of the door, e.g., as a result of striking the garage wall by the door, or during parking because of relatively small space between the parking spots.

The drawback of the door hinge assembly with an integral door lock, which is disclosed in the Italian patent, is substantially eliminated in German Patent No. 3,229,766. However, the door hinge assembly disclosed in both Italian and German patents has a common drawback, consisting in that a number of possible indexing positions is limited to two such positions.

Accordingly, an object of the present invention is a door lock for a motor vehicle door and an integral door hinge assembly with the door lock, which would have an abutment roller arrangement able to provide more than two indexing positions of the door during an opening movement of the door.

Another object of the invention is a door lock for a motor vehicle door and an integral door hinge assembly with the door lock in which the oscillating movement of the door in the region of an indexing position is prevented, and a reliable indexing of the door in a selected opening position is insured.

A further object of the invention is a door lock for a vehicle door and a door hinge assembly with the door lock which would provide for reduced manufacturing and mounting costs.

A still further object of the present invention is a door lock for a motor vehicle door and an integral door hinge assembly with the door lock which would insure a faultless mounting of the abutment rollers in the door hinge assembly.

SUMMARY OF THE INVENTION

This and other objects of the present invention, which will become apparent hereinafter, are achieved by providing a door lock of the above-described type in which there are provided at least three identically shaped abutment rollers arranged next to each other and having, at least along a portion of their height, a heart-shaped cardioid cross-section, with the bearing axles of the abutment rollers being spaced from each other by a distance less than the maximal diameter of the abutment roller cross-section. The deviation, according to the present invention, of the shape of an abutment roller from, used up to the present, conventional substantially circular shape of the abutment roller, which shape was preferred because of a need to provide the abutment roller with a peripheral toothing, permitted, together with an easy manufacturing of an abutment roller from a section of a profile material, to provide more than two indexing positions of the door, as well as faultless mounting of the abutment rollers, as, during mounting of the abutment rollers, their mutual alignment follows from their shape. Likewise, during the actuation of the door lock, any rotation of the abutment roller in an opposite direction is automatically prevented.

According to a preferred embodiment of the present invention, the abutment rollers have in their central region a circular cross-section and two opposite radially extending wings, with one of the wings having a recess and another of the wings having a wedge shape with smooth surfaces.

According to the present invention, it is further contemplated that the wings of each abutment roller are formed symmetrically relative to each other, and the recess has a contour corresponding to a cross-section of the weighting arm of the torsional spring. While generally the weighting arm of the torsional spring has a circular cross-section, in particular cases the cross-section of the weighting arm can deviate from being circular. For example, the weighting arm may have a square cross-section. In a preferred embodiment of the door lock according to the present invention, the weighting arm of the torsional spring has a circular cross-section, and the recesses of two adjacent abutment rollers form together a semicircle. This insures, advantageously, a clearance-free, without a backward movement, movement of the weighting arm from one abutment roller to another abutment roller, so that the weighting arm slides, during the movement of the door, from an indexing recess of one abutment roller into an indexing recess of another abutment roller without any disturbance, insuring a continuous transition and noiseless movement of the door.

According to a preferred embodiment of the abutment roller, the side surfaces of the wedge-shaped wing form with each other an angle of 97°. The wedge-shaped wing forms a pivot stop for the abutment roller, limiting pivot movement of the abutment roller to an angle of 90°–100° and, preferably 97°.

According to the preferred embodiment of the invention, the abutment rollers, by virtue of being formed of an elongate section of a continuous profiled material, have the same cross-section along their entire length.

According to yet another preferred embodiment of the invention, the bearing axles have a circumferential knurled portion, which insure their securing against rotation in the bores of the corresponding hinge half, with the knurled portion forming a rivet spigot. At that, the abutment roller is supported on the bearing axle by a spring washer, which acts against a load braking the pivotal movement of the abutment roller, preventing self-induced rotation of the abutment roller. This further insures a noiseless operation of the door lock. According to the invention, the bearing axles are arranged along a curve which is concentric relative to the hinge axis.

According to the present invention, the abutment roller supporting hinge half is formed of a folded sheet material section and has an abutment support on which the abutment roller is supported and which is provided with a stop recess for receiving a door catch.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figure 1:
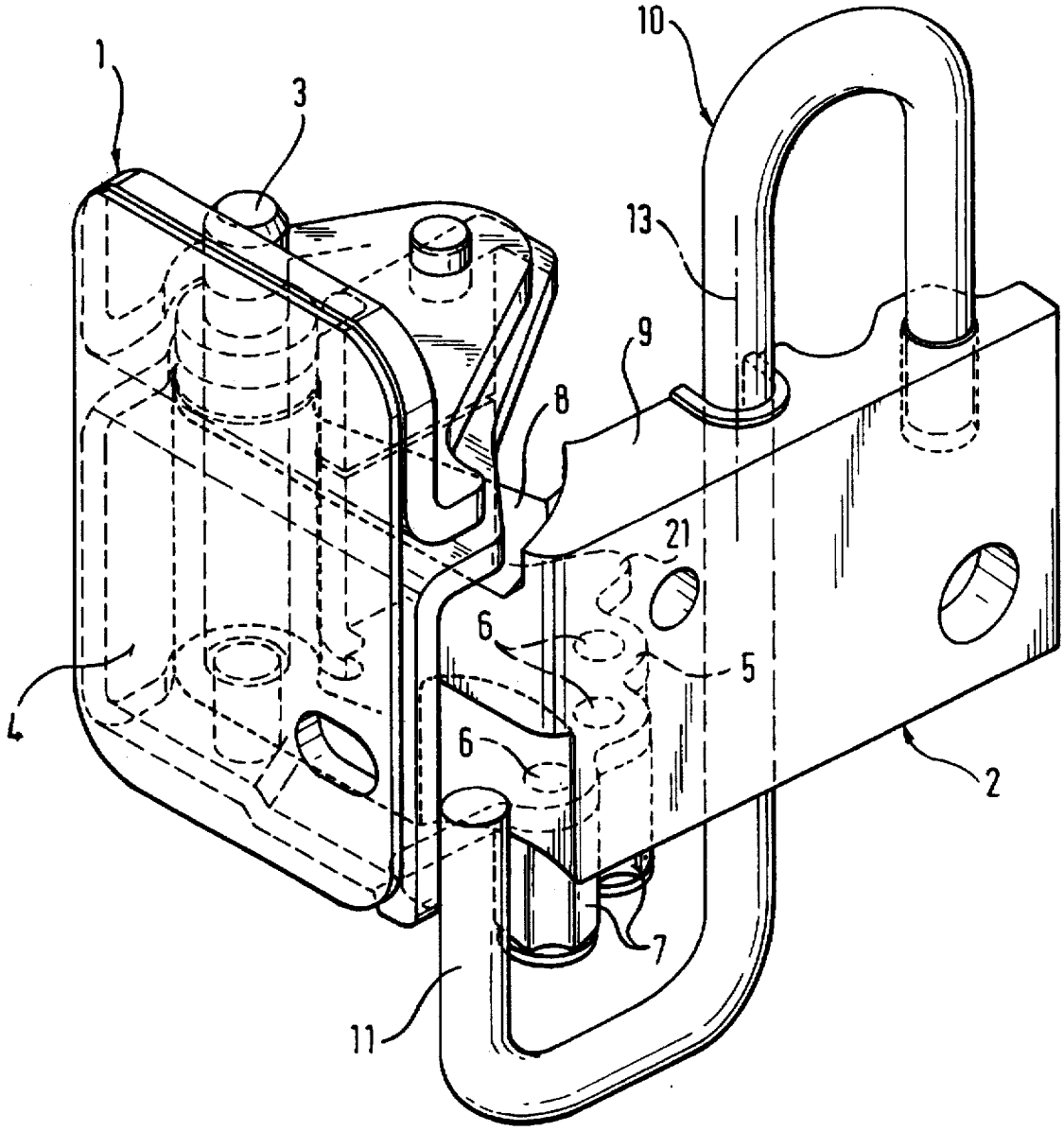
FIG. 1 is a schematic perspective view of a door lock according to the present invention formed integrally with a door hinge.
Figure 2:
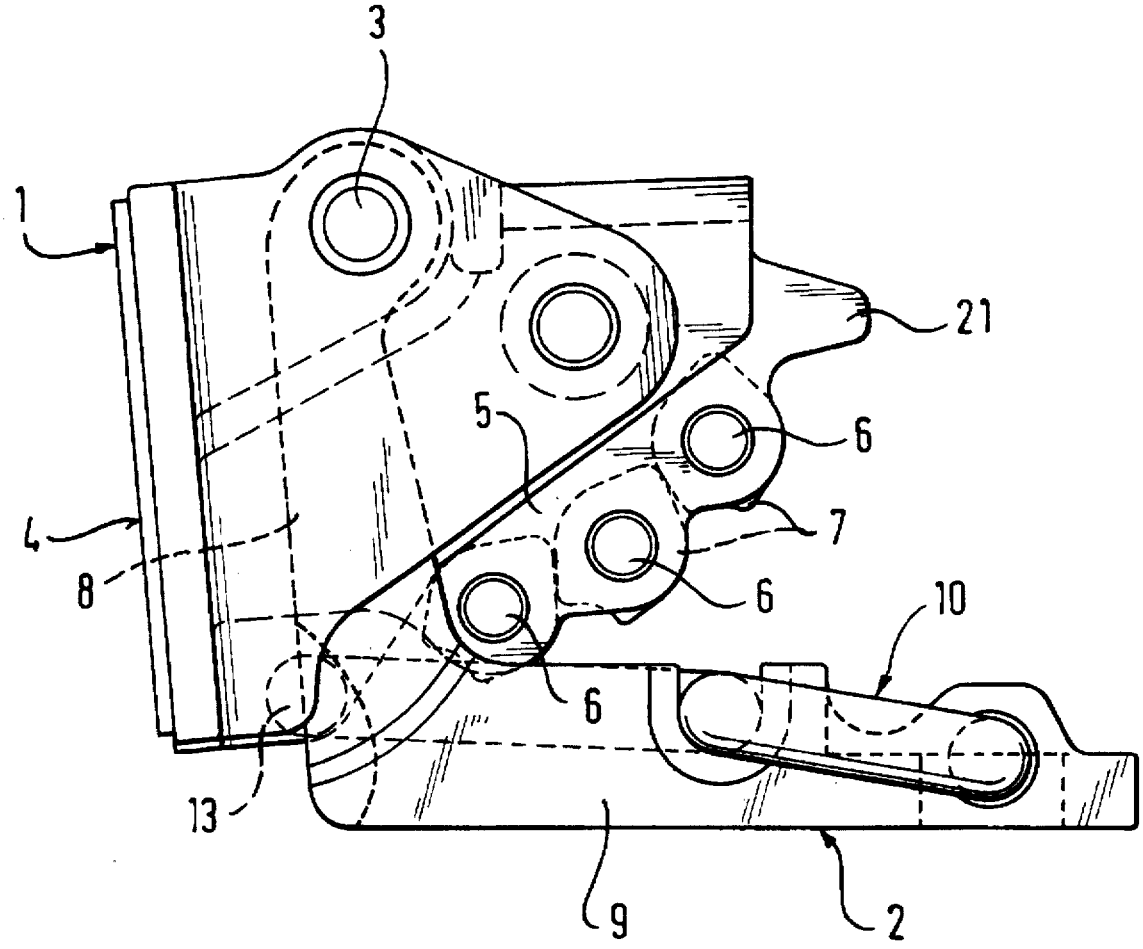
FIG. 2 is a plan view of the door lock-hinge assembly shown in FIG. 1.
Figure 3:
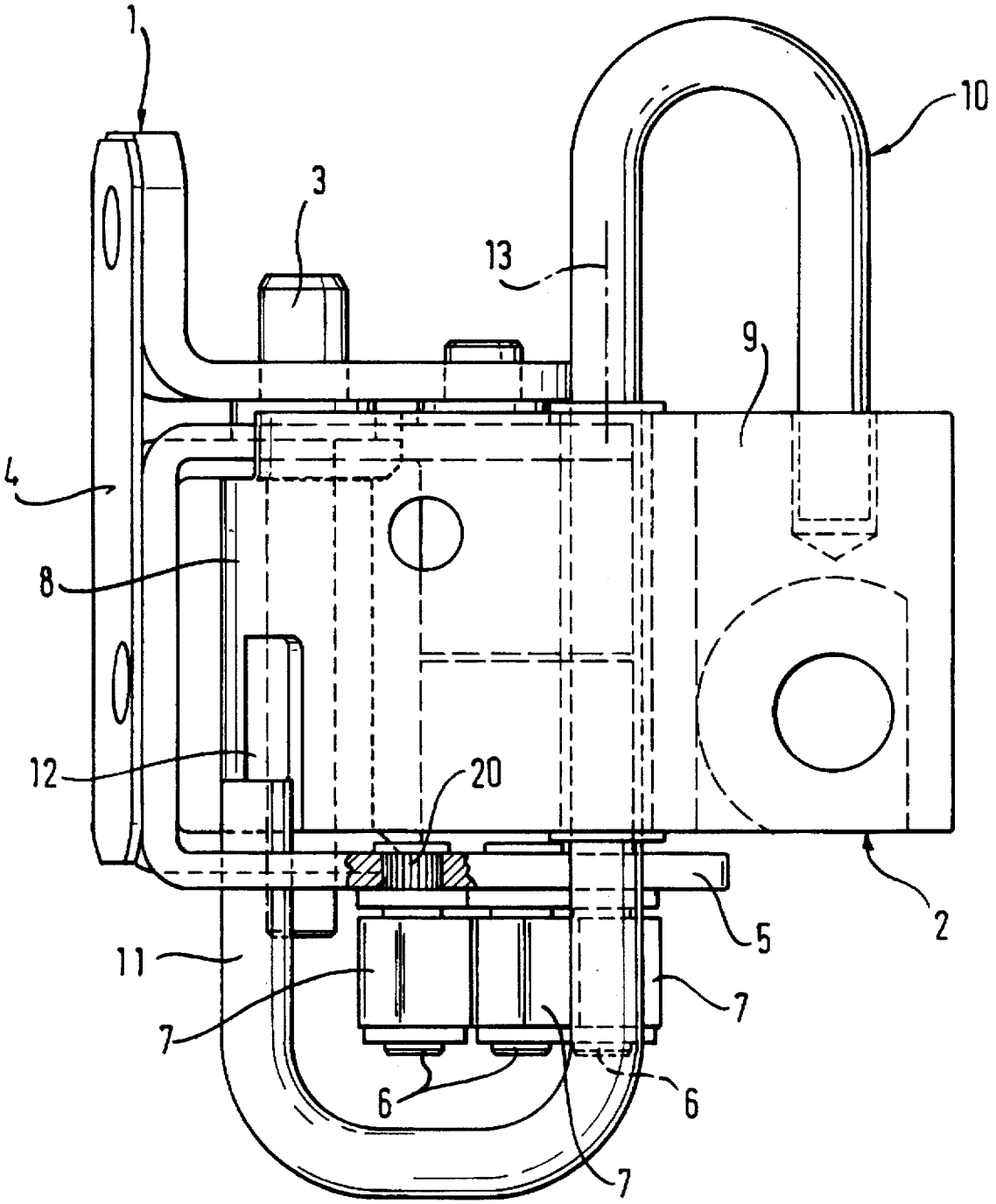
FIG. 3 is a side view of the door lock-hinge assembly shown in FIG. 1.
Figure 4:
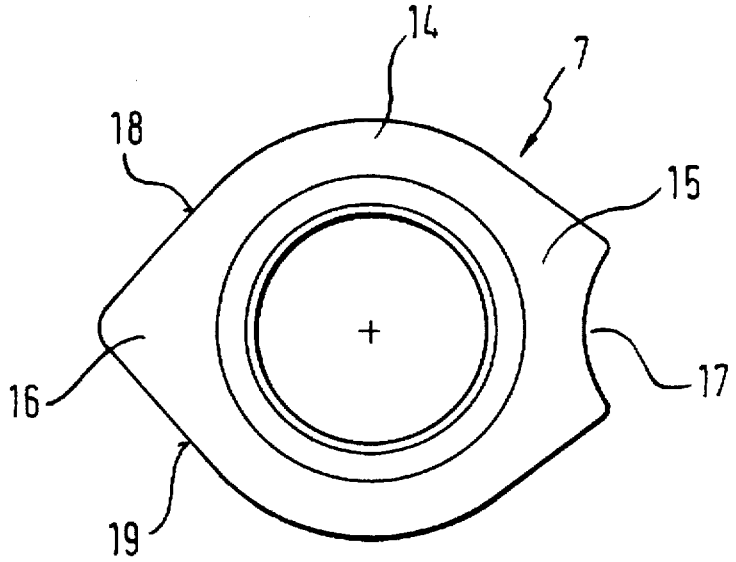
FIG. 4 is a plan view of an abutment roller at an increased scale.
Figure 5:
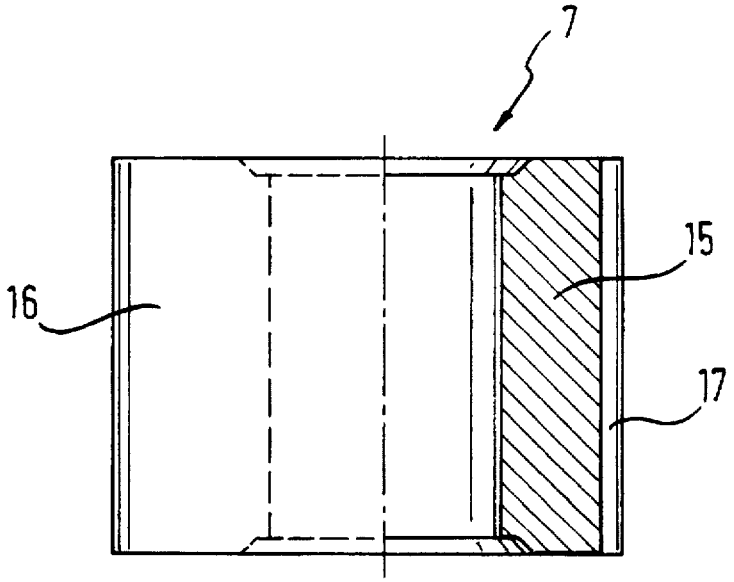
FIG. 5 is a cross-sectional view of the abutment roller shown in FIG. 4.

FIGS. 1–3 of the drawings show a door lock according to the present invention, which is formed integrally with a door hinge. The door hinge shown in the drawings consists of a first hinge half 1, which encompasses one part of a motor vehicle door assembly, not shown in detail in the drawings, and a second hinge half 2, which engages another part of the motor vehicle door assembly, likewise not shown in detail in the drawings.

A hinge pin 3 pivotally connects the two hinge halves 1 and 2 with each other. The first hinge half 1 is formed, in per se known manner, of a folded sheet material section and has an abutment support 5, which extends somewhat perpendicular to its stop base 4. The abutment support 5 supports the bearing axles 6 of abutment rollers 7. The other hinge half 2 has a somewhat L-shaped cross-section and is pivotally supported on the hinge pin 3 with its profiled leg 8. The other leg 9 of the L-shaped hinge half 2 serves for attaching the hinge half 2 to the corresponding part of the door assembly.

A torsional spring 10 is supported, in per se known manner, on the hinge half 2 with its shaft portion. The torsional spring 10 is so supported on the hinge half 2 that its weighting arm 11 projects beyond the hinge half 1. The weighting arm 11 is engaged in a recess 12 of the hinge half 2, whereby the pivotal movement of weighting arm 11 about the axis 13 of the shaft of the torsional spring 10 is limited.

In the embodiment of the inventive door lock shown in the drawings, the abutment rollers are identically shaped along their entire height and have essentially a heart-shaped cardioid cross-section. More specifically, in the central region, the abutment rollers 7 have a circular cross-section. The abutment rollers 7 further include two opposite, symmetrical with respect to each other, radially extending wings 15 and 16. The wing 15 is provided with an indexing recess 17, and the wing 16 is formed as a wedged section having smooth surfaces. The indexing recess 17 in the wing 15 has a contour corresponding to the cross-section of the weighting arm 11 of the torsional spring 10. In the embodiment shown in the drawings, the indexing recess 17 of the wings 15 has a contour of a quarter of a circle, so that the recesses 17 in the wing 15 of two adjacent abutment rollers 7, pivoted relative to each other, form a semi-circle.

Both side surfaces 18 and 19 of the smooth surface, wedge-shaped wing 16 form an angle of 97° with each other. Because the wedge-shaped wing 16 forms a pivot stop for a respective abutment roller 7, the maximum possible pivot angle of adjacent abutment rollers is limited to 97°. The abutment rollers 7 have, along their entire height, a uniform cross-section. As discussed above, the abutment rollers 7 are supported on bearing axles 6, which are secured in respective bores of the abutment support 5 against rotation by their knarled peripheral surface, forming fixed rivet spigots.

The bearing axles 6 of the abutment rollers 7 are arranged on the abutment support 5 of the hinge half 2 along a curve concentric with respect to the hinge axis. The second hinge half 2 has, in the region of its free end, a fixed recessed stop for a door catch.

While the present invention was shown and described with reference to the preferred embodiments, various modifications will be apparent to those skilled in the art and, therfore, it is not intended that the invention be limited to the disclosed embodiments or details thereof, and departure can be made therefrom within the spirit and scope of the appended claims.

What is claimed is:

1. A door lock for a motor vehicle door and which is to be formed integrally with a motor vehicle door hinge having a first hinge half and a second hinge half provided with an abutment support extending perpendicular to a door hinge axis, the door lock comprising:

a torsional spring to be supported on the first hinge half and having a weighting arm which extends parallel to a door hinge axis and projects beyond a door hinge height;

at least three, substantially identical abutment rollers having a substantially heart-shaped cardioid cross-section at least along a portion of a height thereof and to be pivotally supported next to each other in a spaced relationship relative to the door hinge axis on the abutment support, the abutment rollers in cooperation with the weighting arm of the torsional spring defining indexing positions in which the door can be retained during an opening movement thereof; and three bearing axles for supporting the abutment rollers on the abutment support, the bearing axles to be arranged on the abutment support at a distance from each other which is less than a largest diameter of the cross-section of the abutment rollers.

2. A door lock as set forth in claim 1, wherein the abutment rollers have, in a central region thereof, a circular cross-section and two opposite radially extending wings, and wherein one of the wings has a recess and another of the wings has a wedge shape with smooth surfaces.

3. A door lock as set forth in claim 2, wherein both wings of each abutment roller are formed symmetrically relative to each other, and wherein the recess has a contour corresponding to a cross-section of the weighting arm of the torsional spring.

4. A door lock as set forth in claim 2, wherein side surfaces of the wedge-shaped wing form with each other an angle of 97°.

5. A door lock as set forth in claim 2, wherein the wedge-shaped wing forms a pivot stop for the abutment roller, limiting pivot movement of the abutment roller to an angle of 90°–100°.

6. A door lock as set forth in claim 5, wherein the wedge-shaped wing limits the pivot angle of the abutment roller to an angle of 97°.

7. A door lock as set forth in claim 2, wherein the weighting arm of the torsional spring has a circular cross-section, and wherein the recesses of two adjacent abutment rollers form together a semicircle.

8. A door lock as set forth in claim 1, wherein the bearing axles of the abutment rollers are to be arranged along a curve which is concentric relative to the hinge axis.

9. A door lock as set forth in claim 1, wherein the abutment rollers have a same cross-section along an entire height thereof.

10. A door lock as set forth in claim 1, further comprising a spring washer for braking the pivotal movement of the abutment rollers.

11. A door hinge assembly for a motor vehicle door, comprising:

a hinge having a first hinge half and a second hinge half provided with an abutment support extending transverse to a hinge axis; and a door lock formed intergrally with the hinge and comprising:

a torsional spring supported on the first hinge half and having a weighting arm which extends parallel to a door hinge axis and projects beyond a door hinge height;

at least three, substantially identical abutment rollers having a substantially heart-shaped cardioid cross-section, at least along a portion of a height thereof, and pivotally supported next to each other and in a spaced relationship relative to the door hinge axis on the abutment support, the abutment rollers in cooperation with the weighting arm of the torsional spring defining indexing positions in which the door can be retained during an opening movement thereof; and three bearing axles for supporting the abutment rollers on the abutment support, the bearing axles to be arranged on the abutment support at a distance from each other which is less than the largest diameter of the cross-section of the abutment rollers.

12. A door hinge assembly as set forth in claim 11, wherein the abutment support has a stop recess for receiving a door catch.

13. A door hinge assembly as set forth in claim 11, wherein the second hinge half is formed of a folded sheet material section, and wherein the bearing axles have a circumferential knurled portion for being secured in respective bores of the abutment support against rotation, the knurled portion forming a rivet spigot.

* * * * *